US009735512B2

(12) United States Patent
Hsu et al.

(10) Patent No.: US 9,735,512 B2
(45) Date of Patent: Aug. 15, 2017

(54) ELECTRICAL CONNECTOR HAVING GOOD ANTI-EMI PERFORMANCE

(71) Applicant: FOXCONN INTERCONNECT TECHNOLOGY LIMITED, Grand Cayman (KY)

(72) Inventors: Kuo-Chun Hsu, New Taipei (TW); Jian-Kuang Zhu, Kunshan (CN); Chun-Sheng Li, Kunshan (CN); Wei Zhong, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/222,975

(22) Filed: Jul. 29, 2016

(65) Prior Publication Data

US 2017/0033511 A1 Feb. 2, 2017

(30) Foreign Application Priority Data

Jul. 29, 2015 (CN) ..... 2015 2 0554211 U

(51) Int. Cl.

| | |
|---|---|
| ***H01R 9/03*** | (2006.01) |
| ***H01R 13/6596*** | (2011.01) |
| *H01R 13/405* | (2006.01) |
| *H01R 13/6586* | (2011.01) |
| *H01R 24/60* | (2011.01) |

(52) U.S. Cl.

CPC ..... *H01R 13/6596* (2013.01); *H01R 13/405* (2013.01); *H01R 13/6586* (2013.01); *H01R 24/60* (2013.01)

(58) Field of Classification Search

CPC ..... H01R 24/60; H01R 13/65; H01R 13/6593
USPC ..... 439/607.55, 607.27, 607.01, 607.05
See application file for complete search history.

(56) References Cited

U.S. PATENT DOCUMENTS

| | | | | |
|---|---|---|---|---|
| 9,590,360 | B2 * | 3/2017 | Chuang | H01R 13/6581 |
| 2015/0126068 | A1 * | 5/2015 | Fang | H01R 13/6587 439/607.23 |
| 2015/0364871 | A1 * | 12/2015 | Lin | H01R 13/6581 439/607.58 |
| 2016/0049752 | A1 | 2/2016 | Qian et al. | |
| 2016/0111821 | A1 * | 4/2016 | Lan | H01R 13/646 439/607.01 |

* cited by examiner

*Primary Examiner* — Abdullah Riyami
*Assistant Examiner* — Thang Nguyen
(74) *Attorney, Agent, or Firm* — Wei Te Chung; Ming Chieh Chang

(57) ABSTRACT

An electrical connector includes an elongated insultive shell and a terminal module retained in the insultive shell. The terminal module defines a first module, a second module separated from the first module in a vertical direction and a shielding member located between the first module and the second module. The terminal module defines a first shielding plate and a second shielding plate assembled to the corresponding first and second modules respectively, the shielding member is connected together with the first shielding plate and the second shielding plate.

19 Claims, 5 Drawing Sheets

ELECTRICAL CONNECTOR HAVING GOOD ANTI-EMI PERFORMANCE

BACKGROUND OF THE INVENTION

1. Field of the Invention

The present invention relates to an electrical connector, and more particularly to an electrical connector having a good anti-EMI performance. This invention is related to a copending application disclosing the mated connectors, filed on the same day and having the same inventors and the same assignee with the instant invention.

2. Description of the Related Art

With the development of technology, a series of electrical connectors are very popular which are used for transmitting high-frequency signals and have a good anti-EMI performance. One of the electrical connectors includes a shell formed of a polymeric material, a pair of terminal modules and a shielding plate assembled into the shell. The shell is directly injection molded on the terminal modules to form a mating portion having a pair of mating surfaces opposite to each other, each of the terminal modules defines a plurality of conductive terminals exposed on the corresponding mating surface and an insulative block injection molded on the conductive terminals. The shielding plate is disposed between the pair of terminal modules and spaced apart from the conductive terminals by the insulative block so as to not contact with the conductive terminals, which can effectively prevent electromagnetic interference of the conductive terminals. However, with the development needs of high-frequency transmission, the signal interference between the conductive terminals becomes increasingly serious.

Therefore, an improved electrical connector is highly desired to meet overcome the requirement.

BRIEF SUMMARY OF THE INVENTION

An object of the present invention is to provide an electrical connector having a stable structure and a good electromagnetic shielding effect.

In order to achieve above-mentioned object, an electrical connector includes an elongated insultive shell and a terminal module retained in the insultive shell. The terminal module defines a first module, a second module separated from the first module in a vertical direction and a shielding member located between the first module and the second module. The terminal module defines a first shielding plate and a second shielding plate assembled to the corresponding first and second modules respectively, the shielding member is connected together with the first shielding plate and the second shielding plate.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
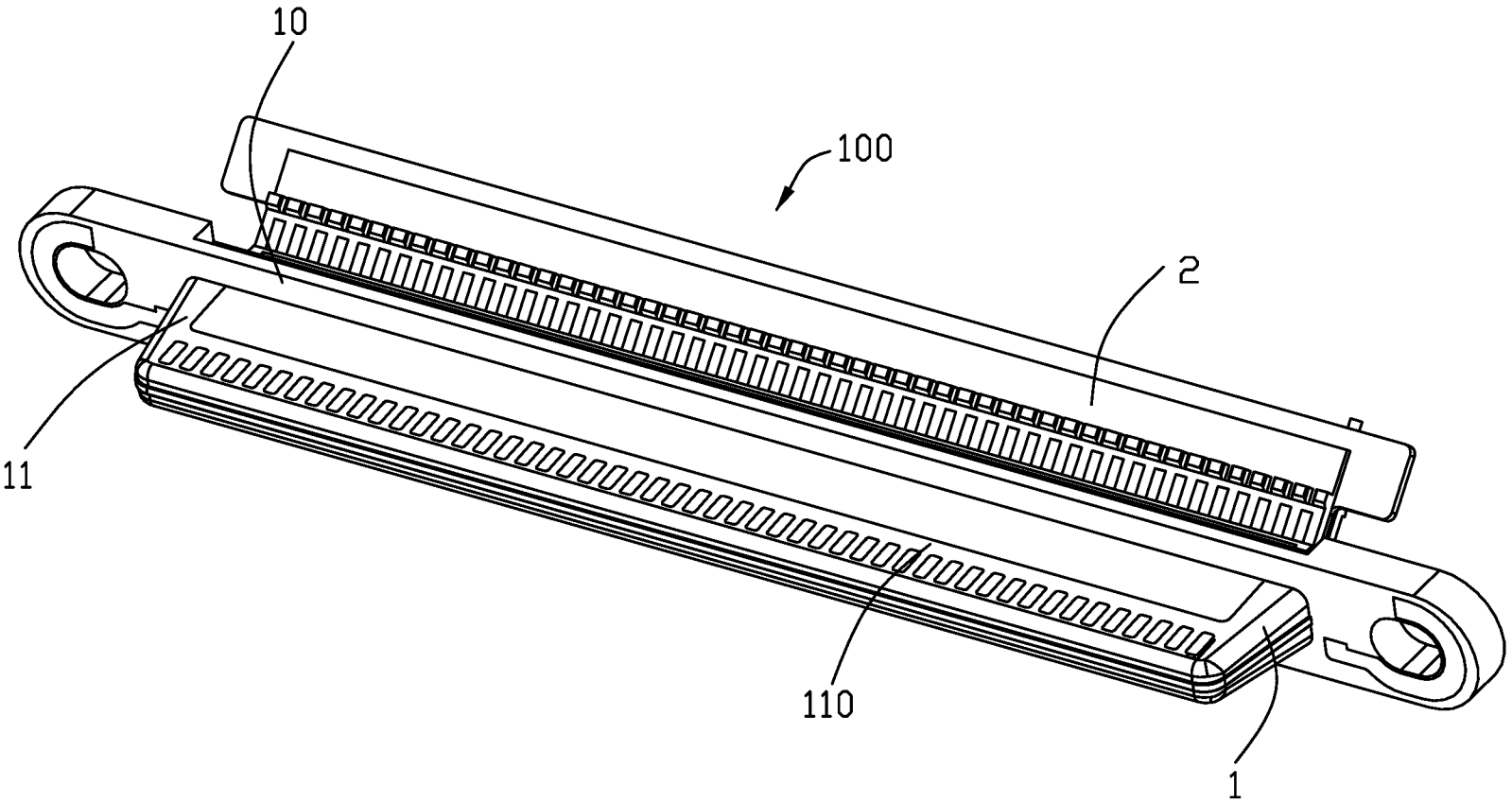
FIG. 1 is a perspective view showing an electrical connector in accordance with the present invention.
Figure 2:
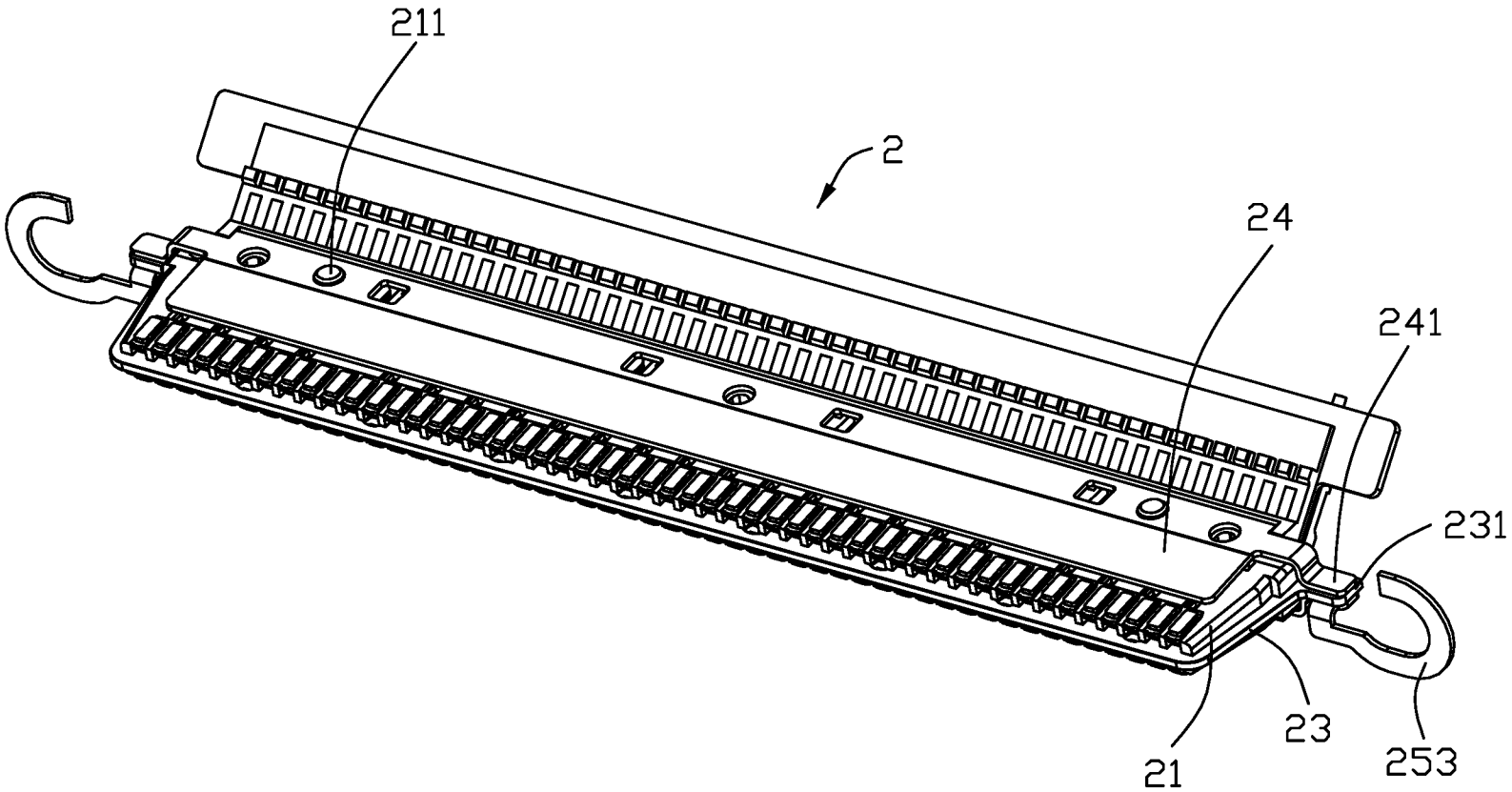
FIG. 2 is a perspective view of a terminal module of the electrical connector shown in FIG. 1.
Figure 3:
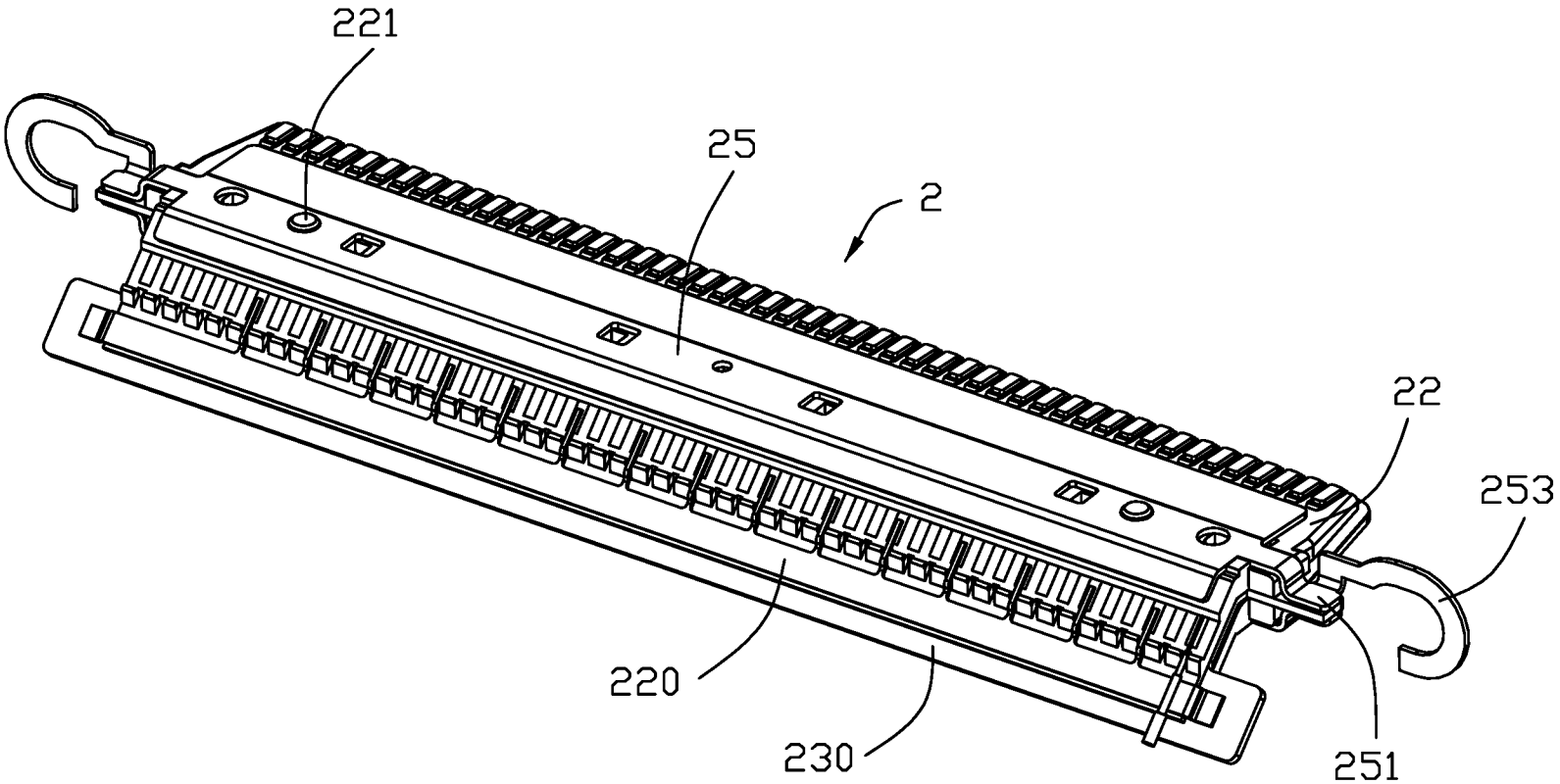
FIG. 3 is another perspective view of the terminal module shown in FIG. 2.

Reference will now be made to the drawing figures to describe a preferred embodiment of the present invention in detail. Referring to FIG. 1 to FIG. 3, an electrical connector 100 is preferably a plug to be mounted to an electronic device for a corresponding mating connector inserted. The electrical connector 100 includes an elongated insulative shell 1 and a terminal module 2 assembled into the insulative shell 1. The insulative shell 1 is directly injection molding on the terminal module 2 and defines a longitudinal base portion 10 and a mating (tongue) portion 11 extending along a mating direction from the front end of the base portion 10, the mating portion 11 defines a pair of mating surfaces 110 located on both sides thereof in a vertical direction perpendicular to the mating direction.

Figure 4:
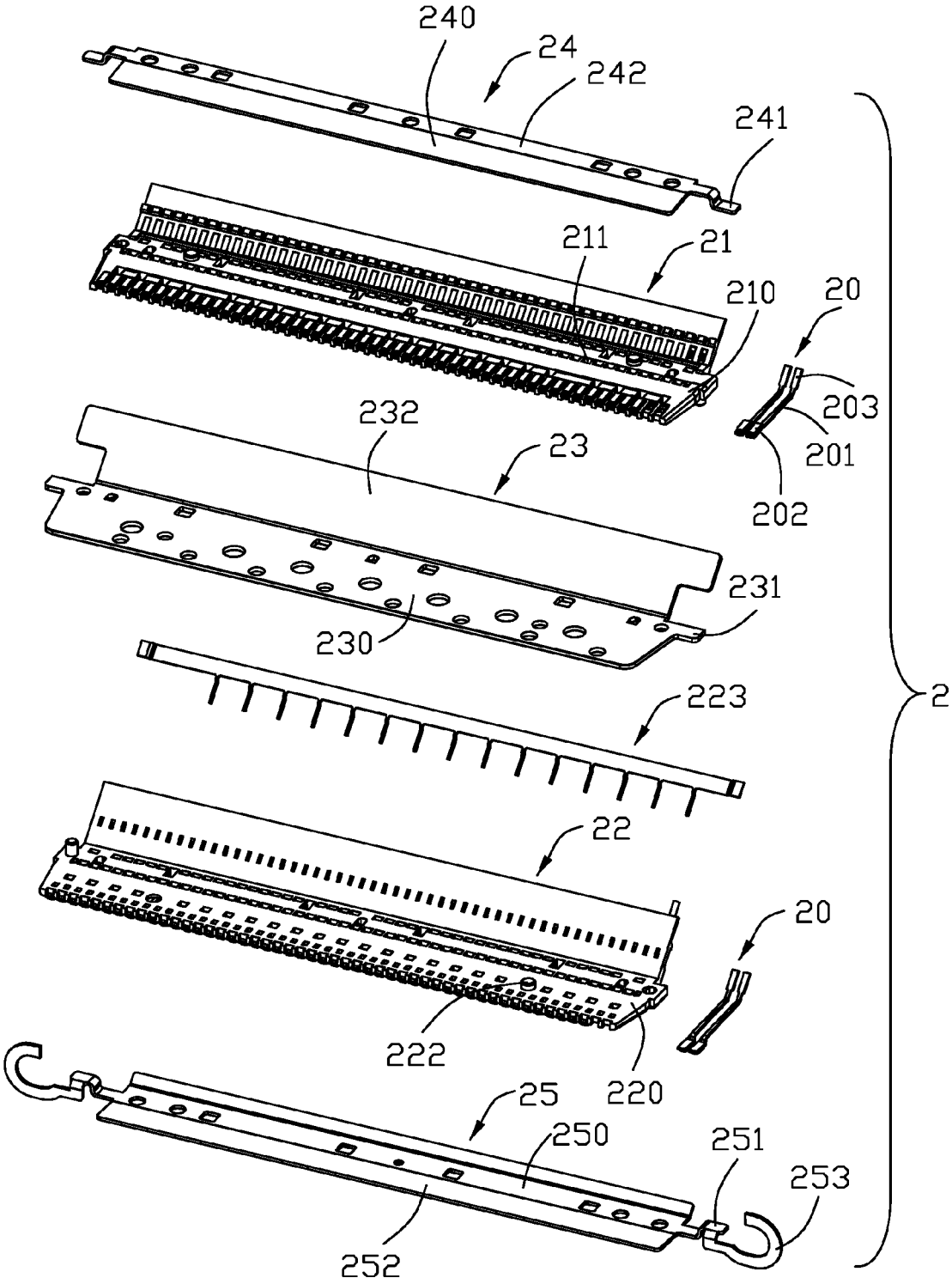
FIG. 4 is an exploded perspective view of the terminal module shown in FIG. 2.
Figure 5:
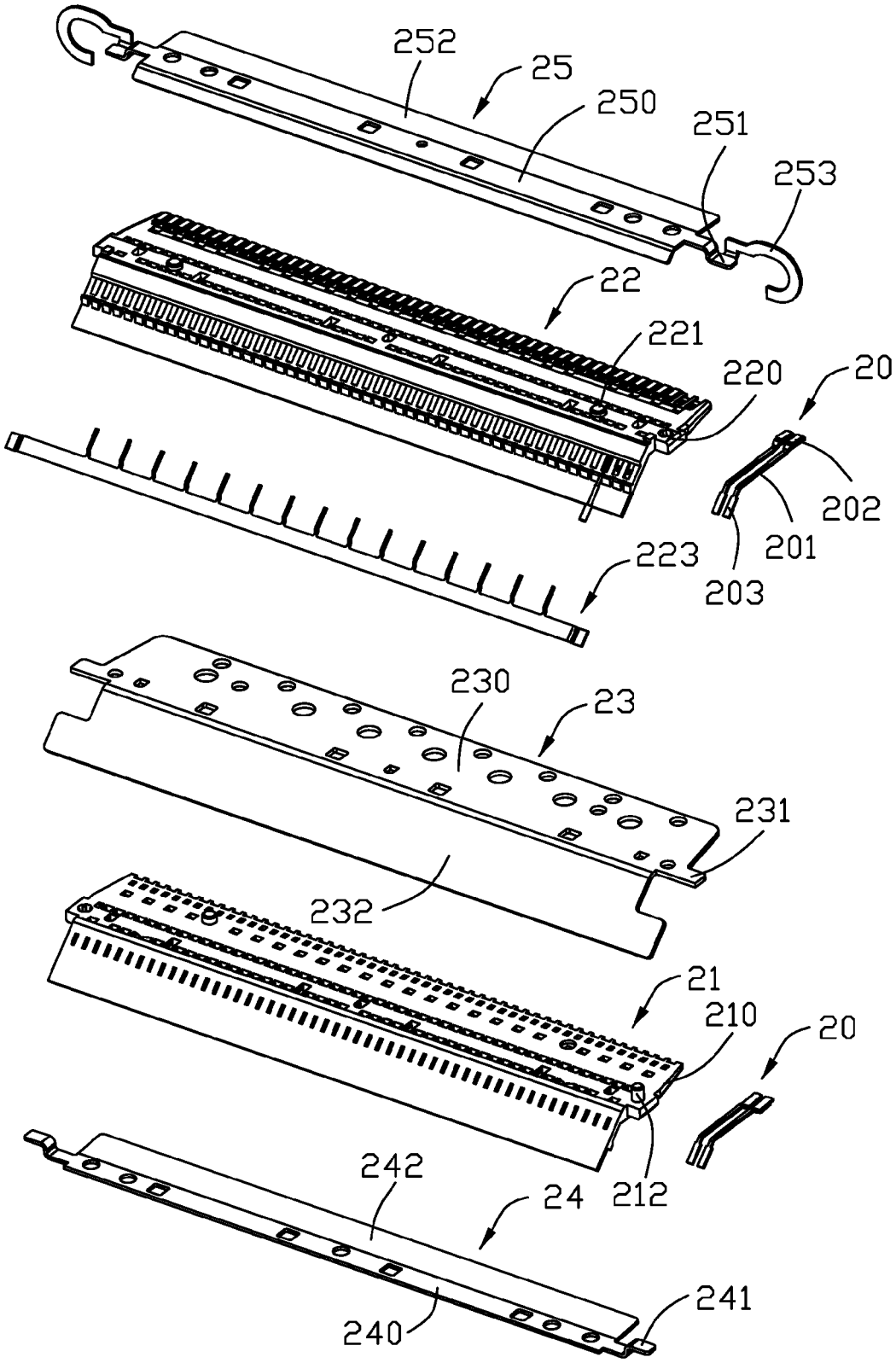
FIG. 5 is an exploded perspective view of the terminal module shown in FIG. 3.

Referring to FIG. 4 to FIG. 5, the terminal module 2 includes a first module 21 and a second module 22 separated from each other in the vertical direction. The first module 21 includes a plurality of conductive terminals 20 and a first insulative block 210 injection molded on the conductive terminals 20, and the second module 22 includes a plurality of conductive terminals 20 and a second insulative block 220 injection molded on the conductive terminals 20, whereby the conductive terminals 20 are secured together better. Each conductive terminal 20 defines a connecting portion 201 retained in the insulative block, a contacting portion 202 extending forwardly from the connecting portion 201 and exposed on mating surface 110, and a tail portion 203 extending outside of the insulative shell 1 from the connecting portion 201. The outer surface of the contacting portion 202 is flush or coplanar with the mating surface 110. Obviously, in other embodiments, the outer surface of the contacting portion 202 may project and locate above the mating surface 110 of the mating portion 11.

The terminal module 2 further includes a shielding member 23 located between the first module 21 and the second module 22, and a first shielding plate 24 and a second shielding plate 25 assembled to the first and second modules, respectively. The shielding member 23 defines a longitudinal body portion 230, a pair of projecting portions 231 projecting outwardly from both sides of the body portion 230 and an extending portion 232 extending rearwardly from the rear end of the body portion 230. Firstly, the shielding member 23 is mounted on the first module 21, wherein the posts 212 of the first insulative block 210 of the first module 21 run through the locking holes of the body portion 230 so that the shielding member 23 is fixed on the first module 21. Then, the second module 22 is mounted on the other side of the shielding member 23, and the posts 222 of the second insulative block 220 of the second module 22 run through the locking holes of the body portion 230 to lock the first insulative block 210 of the first module 21, so that the shielding member 23 is disposed between the first and second modules. The body portion 230 is located between the contacting portions 202 of two rows of the conductive terminals 20, and the projecting portions 231 are extending beyond the both sides of the first and second modules in the longitudinal direction. After the electrical connector 100 is injection molded, the body portion 230 of the shielding member 23 is exposed on the front surface and side surfaces of the mating portion 11, and the distance from the distal end of the body portion 230 to the front surface and side surfaces of the mating portion 11 is about 0.5 mm. It is convenient to overlap between the shielding member 23 and the grounding member of the mating connector, thereby forming a better shielding effect.

The first shielding plate 24 defines an elongated first base portion 240, a pair of first soldering portions 241 bent and extending from both sides of the first base portion 240 and a first shielding portion 242 extending along the mating direction from the front end of the first base portion 240. The first shielding plate 24 is attached to the outer surface of the first module 21, and the posts 211 of the first insulative block 210 of the first module 21 run through the locking holes of the first base portion 240 so that the first shielding plate 24 is fixed on the first module 21, the first soldering portions 241 are soldered on the corresponding projecting portions 231 of the shielding member 23 by a manner, such as soldering or spot-welding.

The structure of the second shielding plate 25 is similar to the structure of the first shielding plate 24, and the second shielding plate 25 defines an elongated second base portion 250, a pair of second soldering portions 251 bent and extending from both sides of the second base portion 250 and a second shielding portion 252 extending along the mating direction from the front end of the second base portion 250. The second shielding plate 25 is attached to the outer surface of the second module 22, and the posts 221 of the second insulative block 220 of the second module 22 run through the locking holes of the second base portion 250 so that the second grounding plate 25 is fixed on the second module 22, the second soldering portions 251 are soldered on the corresponding projecting portions 231 of the shielding member 23 by a manner, such as soldering or spot-welding. The first and second shielding plates are respectively located in opposite sides of the projecting portion 231 of the shielding member 23, the second shielding plate 25 further includes a pair of annular grounding portions 253 bent and extending along a direction perpendicular to the mating direction from the second soldering portions 251. After the electrical connector 100 is injection molded, the first and second shielding portions are respectively exposed on the mating surfaces 110 of the mating portion 11, which is used for contacting the grounding member of the mating connector, thereby forming a better shielding effect.

The terminal module 2 further includes a grounding bar 223 assembled to the rear end of the second module 22, the grounding bar 223 is attached to the tail portions 203 of the grounding terminals of the second module 22 and the lengthwise ends of the grounding bar 223 are soldered on the extending portion 232 of the shielding member 23. It is advantageous to reduce signal interference between two rows of the conductive terminals 20 to providing the shielding member 23, thereby improving the electrical performance of the electrical connector 100. The body portion 230 of the shielding member 23 is exposed beyond the front surface and the side surfaces of the mating portion 11, the first shielding portion 241 and the second shielding portion 251 are exposed on the mating surfaces 110 of the mating portion 11, so that the shielding member 23 can engage with the contacting member of the mating connector when the electrical connector is engaged with the mating connector, which plays a role in the elimination of static electricity and further improves the electrical performance of the electrical connector 100. When the electrical connector 100 is assembled to the electronic device, the grounding portions 253 of the second shielding plate 25 are shorted together with the shell of the electronic device by riveting, which further improves the electrical performance of the electrical connector 100.

From the above description in the present embodiment, a method of manufacturing the electrical connector 100 may have the following steps:

(a). providing two rows of conductive terminals 20, a pair of insulative blocks are respectively injection molded on the two rows of conductive terminals 20 to form a first module 21 and a second module 22, each conductive terminal 20 defines a contacting portion 201 exposed on outer surface of the corresponding insulative block;

(b). providing a shielding member 23, the shielding member 23 defines a body portion 230, a pair of projecting portions 231 projecting outwardly from both sides of the body portion 230 and an extending portion 232 extending rearwardly from the rear end of the body portion 230; firstly, the shielding member 23 is mounted on the first module 21, then the first and second modules are fixed together so that the body portion 230 of the shielding member 23 is located between the first and second modules, and the projecting portions 231 are extending beyond the insulative blocks;

(c). providing a first shielding plate 24 and a second shielding plate 25, the first and second shielding plates are respectively mounted on the opposite sides of the first and second modules, and the first soldering portions 241 of the first shielding plate 24 and the second soldering portions 251 of the second shielding plate 25 are respectively soldered on opposite sides of the projecting portions;

(d). providing a grounding bar 223, the grounding bar 223 is attached to the grounding terminals of the second module 22 and the lengthwise ends of the grounding bar 223 are soldered on the extending portion 232 of the shielding member 23 to form the terminal module 2;

(e). providing an insulative shell 1 directly injection molding on the terminal module 2, the insulative shell 1 defines a mating portion 11 extending along the mating direction, the mating portion 11 defines a pair of mating surfaces 110 located on both sides thereof in the vertical direction perpendicular to the mating direction, the contacting portions 201 of the conductive terminals 20 of the terminal module are exposed on the mating surfaces 110 of the insulative shell 1. The method of manufacturing the electrical connector 100 makes the electrical connector 100 having a good anti-electromagnetic interference effect.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector, comprising:

an elongated insulative shell; and a terminal module retained in the insulative shell and defining a first module, a second module separated from the first module in a vertical direction and a shielding member located between the first module and the second module; wherein the terminal module defines a first shielding plate and a second shielding plate assembled to the corresponding first and second modules respectively, the shielding member is connected together with the first shielding plate and the second shielding plate; and wherein the shielding member defines a longitudinal body portion and a pair of projecting portions projecting outwardly from both sides of the body portion, the first shielding plate defines a first base portion attached to the outer surface of the first module and a pair of first soldering portions bent and extending from both sides of the first base portion, the second shielding plate defines an second base portion attached to the outer surface of the second module and a pair of second soldering portions.

2. The electrical connector as described in claim 1, wherein the insulative shell is directly injection molding on the terminal module and defines a longitudinal base portion and a mating portion extending along a mating direction perpendicular to the vertical direction from the front end of the base portion, the mating portion defines a pair of mating surfaces located on both sides thereof in the vertical direction, the projecting portions of the shielding member are extending beyond the both sides of the first and second modules in a longitudinal direction, and the first and second soldering portions are respectively located in opposite sides of the projecting portions of the shielding member.

3. The electrical connector as described in claim 2, wherein the body portion of the shielding member is exposed on the front surface and side surfaces of the mating portion, and the distance from the distal end of the body portion to the front surface and side surfaces of the mating portion is about 0.5 mm.

4. The electrical connector as described in claim 2, wherein the first shielding plate defines a first shielding portion extending along the mating direction from the front end of the first base portion, the second shielding plate defines a second shielding portion extending along the mating direction from the front end of the second base portion, and the first and second shielding portions are respectively exposed on the mating surfaces of the mating portion.

5. The electrical connector as described in claim 1 wherein each of the first and second modules includes a plurality of conductive terminals and an insulative block injection molded on the conductive terminals, the body portion of the shielding member is located between the insulative blocks of the first module and the second module.

6. The electrical connector as described in claim 5, wherein the body portion of the shielding member defines a plurality of locking holes, each of the first and second modules defines a plurality of posts corresponding to the locking holes, and the posts are running through the locking holes and fixed on the shielding member.

7. The electrical connector as described in claim 5, wherein each conductive terminal defines a connecting portion retained in the insulative block, a contacting portion extending forwardly from the connecting portion and exposed on mating surface, and a tail portion extending outside of the insulative shell from the connecting portion, the outer surface of the contacting portion is flush or coplanar with the mating surface.

8. The electrical connector as described in claim 1, wherein the second shielding plate further includes a pair of annular grounding portions bent and extending along a direction perpendicular to a mating direction from the second soldering portions.

9. The electrical connector as described in claim 1, wherein the shielding member defines an extending portion extending rearwardly from the rear end of the body portion, and the terminal module further includes a grounding bar assembled to the rear end of the second module, the grounding bar is attached to the second module and the lengthwise ends of the grounding bar are soldered on the extending portion of the shielding member.

10. An electrical connector comprising:

a terminal module including:

a first module having a plurality of first terminals enclosed within a first insulative block via an insert-molding process, each of said first terminals including a first contacting section exposed upon the first insulative block and communicating with an exterior in a first direction;

a second module having a plurality of second terminals enclosed within a second insulative block via another insert-molding process, each of said second terminals including a second contacting section exposed upon the second insulative block and communicating with the exterior in a second direction approximately opposite to said first direction;

a metallic shielding member sandwiched between the first module and the second module;

a metallic first shielding plate positioned upon said first insulative block and behind the first contacting sections with a distance, and an insulative shell applied upon the first insulative block and the first shielding plate so as to have the first contacting sections, said shielding member and one surface of said insulative shell commonly lie in a same mating plane; wherein the shielding member and the first shielding plate are electrically and mechanically connected to each other.

11. The electrical connector as claimed in claim 10, further including a metallic second shielding plate positioned upon the second insulative block and behind the second contacting sections, wherein said insulative shell is further applied upon the second insulative block so as to have the second contacting sections, the second shielding plate and another surface of said insulative shell lie in another same mating plane, and wherein said second shielding plate and said shielding member are electrically and mechanically connected to each other.

12. The electrical connector as claimed in claim 11, wherein said insulative shell is further applied upon the first shielding plate to form a base portion of the whole electrical connector, and a mating portion extends from the base portion between said two mating planes.

13. The electrical connector as claimed in claim 12, wherein said base portion forms a through hole at one longitudinal end, and the first shielding plate includes a grounding portion located around said through hole and exposed to the exterior in a mating direction along which said mating portion extends.

14. The electrical connector as claimed in claim 13, wherein said base portion forms another through hole at an opposite longitudinal end, and the second shielding plate includes another grounding portion located around said another through hole and exposed to the exterior in said mating direction.

15. The electrical connector as claimed in claim 11, wherein said first insulative block includes a first post engaged within a corresponding hole in the first shielding plate, a second post engaged within another corresponding hole in the shielding member.

16. The electrical connector as claimed in claim 15, wherein said first insulative block further includes a third post engaged with another corresponding hole in the second insulative block, and said third post is either said second post or not said second post.

17. The electrical connector as claimed in claim 10, wherein said first shielding plate include a first hole receiving a corresponding post of the first insulative block, and a second hole occupied by the first insulative shell.

18. A method of making an electrical connector comprising steps of:

providing a first module with a plurality of first terminals embedded within a first insulative block via a first insert-molding process wherein first contacting sections of said first terminals are exposed;

providing a second module with a plurality of second terminals embedded within a second insulative block via a second insert-molding process wherein second contacting sections of said second terminals are exposed;

providing a metallic shielding member sandwiched between said first module and second module;

applying a metallic first shielding plate upon the first insulative block to mechanically and electrically connect to the shielding member;

applying a metallic second shielding plate upon the second insulative block to mechanically and electrically connect to the shielding member; and applying an insulative shell upon all said first module, said first shielding plate, said second module and said second shielding plate via an overmolding process so as to expose the first contacting sections and the first shielding plate in a first mating surface and exposed the second contacting sections and the second shielding plate in a second mating surface approximately opposite to said first mating surface.

19. The method as claimed in claim 18, wherein said insulative shell forms a base portion extending along a longitudinal direction, a mating portion extends forwardly from the base portion in a mating direction perpendicular to said longitudinal direction, said first shielding plate includes a first grounding portion exposed upon one longitudinal end of the base portion, and said second shielding plate include a second grounding portion exposed upon the other longitudinal end of the base portion.

* * * * *